US008019459B2

(12) United States Patent
Yamada

(10) Patent No.: US 8,019,459 B2
(45) Date of Patent: Sep. 13, 2011

(54) DATA PROCESSOR AND COMPUTER READABLE MEDIUM

(75) Inventor: Kenji Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 681 days.

(21) Appl. No.: 12/222,024

(22) Filed: Jul. 31, 2008

(65) Prior Publication Data

US 2009/0043417 A1 Feb. 12, 2009

(30) Foreign Application Priority Data

Aug. 8, 2007 (JP) ..... 2007-206431

(51) Int. Cl.
*D05C 5/02* (2006.01)

(52) U.S. Cl. ..... 700/138; 112/102.5; 112/470.06

(58) Field of Classification Search ..... 700/136–138; 101/481, 485; 112/102.5, 470.01, 470.04, 112/470.06, 475.09, 475.19
See application file for complete search history.

(56) References Cited

U.S. PATENT DOCUMENTS 5,144,899 A * 9/1992 Allen ..... 112/470.06
5,855,176 A * 1/1999 Takenoya et al. ..... 112/102.5
6,158,366 A * 12/2000 Codos ..... 112/475.19
6,832,569 B2 * 12/2004 Krasnitz ..... 112/103
7,854,207 B2 * 12/2010 Kuki et al. ..... 700/136
2006/0096510 A1 5/2006 Kuki et al.

FOREIGN PATENT DOCUMENTS

| | | |
|---|---|---|
| JP | A-60-115499 | 6/1985 |
| JP | B2-2982427 | 9/1999 |
| JP | A-2006-130124 | 5/2006 |
| JP | A-2006-130819 | 5/2006 |
| JP | A-2006-130820 | 5/2006 |

* cited by examiner

*Primary Examiner* — Gary L Welch
*Assistant Examiner* — Nathan Durham
(74) *Attorney, Agent, or Firm* — Oliff & Berridge, PLC

(57) ABSTRACT

A data processor that processes embroidery data for sewing an embroidery pattern on a workpiece cloth held by an embroidery frame attached to an embroiderable sewing machine, and printing data for printing an image pattern with a printer to be transferred onto the workpiece cloth through a thermal transfer sheet, the data processor including a printing data processor that includes reference-mark printing data for printing a reference mark with the printer on a back side of the thermal transfer sheet, the reference mark being used for positioning the workpiece cloth relative to the embroidery frame, and a print position specifier that specifies printing position of the image pattern relative to the reference mark, the image pattern being printed on a front side of the thermal transfer sheet; and an embroidery data processor that includes a sew position specifier that specifies sew position of the embroidery pattern relative to the reference mark.

18 Claims, 15 Drawing Sheets

DATA PROCESSOR AND COMPUTER READABLE MEDIUM

CROSS-REFERENCE TO RELATED APPLICATIONS

This application is based upon and claims the benefit of priority from the prior Japanese Patent Application 2007-206431, filed on Aug. 8, 2007, the entire contents of which are incorporated herein by reference.

FIELD

The present disclosure relates to a data processor and a data processing program stored in a computer readable medium that allows formation of an embroidery pattern at a predetermined location of an image pattern which has been printed on a thermal transfer sheet and thermally transferred onto a workpiece cloth.

BACKGROUND

Conventional embroidery sewing machines allow a user to form desired embroidery patterns on a workpiece cloth held by an embroidery frame which is transferred independently in two directions according to embroidery data. On the other hand, various printing techniques have been proposed to print image patterns on a workpiece cloth. One of such examples is an ink-jet printer that forms image patterns on the workpiece cloth by relatively transferring the workpiece cloth held by the embroidery frame and a print head in two directions.

Nowadays, various thermal transfer techniques have been proposed to thermally transfer an image pattern on a workpiece cloth. In one example, a printer is used to create color printing of a given pattern desired by a user on a heat-resistive thermal transfer sheet (film sheet) available in the market. Then, the image pattern printed on the thermal transfer sheet is thermally transferred onto the workpiece cloth such as handkerchiefs and T-shirts. Finally, desired embroidery patterns are formed on the workpiece cloth so as to partially overlap with the image pattern transferred onto the workpiece cloth. The user is allowed to make his/her original hand-made articles such as T-shirts and handkerchiefs in the above described manner.

One example of the above described configuration is disclosed in JP S60-115499 A (hereinafter referred to as reference 1). Reference 1 discloses a method of making a transfer print cloth. First, a cloth is prepared that is backed with non-woven fabric and that has embroidery patterns pre-sewn by gold and silver stitches on its surface. Then a transfer sheet bearing a printed pattern is placed over the pre-sewn embroidery pattern so that the printed pattern is in proper positioning relative to the embroidery pattern. Then, by applying heat pressure on the laminated workpiece with an iron, the pattern printed on the transfer sheet is transferred to the cloth by sublime transfer.

JP 2006-130820 A (hereinafter referred to as reference 2) discloses a data processor and a method of pattern formation. In the disclosed method, reference mark printing data is generated for printing a couple of reference marks within an embroidery pattern area. Image-pattern printing data for printing an image pattern and the reference mark printing data are outputted to a printer while embroidery data is outputted to an embroidery sewing machine. Then, after the printer prints the image pattern and the couple of reference marks on a workpiece cloth based on the image pattern printing data and the reference mark printing data, the reference marks are read by an image sensor. Then, embroidery data is corrected so that needle drop positions are in proper positioning relative to the reference marks. Finally, an embroidery pattern is sewn based on the corrected embroidery data.

Alternatively, reference-mark sewing data may be generated for sewing a couple of reference marks outside an image pattern area. Embroidery data and reference-mark sewing data are outputted to the embroidery sewing machine while the printing data is outputted to the printer. Then, after the embroidery sewing machine sews the embroidery pattern and the couple of reference marks on the workpiece cloth based on the embroidery data and the reference-mark sewing data, the reference marks are read by the image sensor. Then, the image-pattern printing data is corrected so that a printer reference position is in proper positioning relative to the couple of reference marks sewn on the workpiece cloth. Finally, the image pattern is printed based on the corrected image-pattern printing data.

Transfer print cloth disclosed in reference 1 requires adjustment in the positioning between the pre-sewn embroidery pattern and the image pattern printed on the transfer sheet to assume a predetermined relative positioning. Thus, the user is required to make subtle positional and angular adjustments to locate the printed image pattern to the embroidery pattern, which requires substantial time and effort on the part of the user. Alternatively, the image pattern printed on the transfer sheet may be transferred to the cloth prior to forming the embroidery pattern. In such case, however, it would require even more time and effort for pattern positioning since it is more difficult to form stitches in proper positioning relative to the transferred image pattern.

According to the data processor and pattern formation method disclosed in reference 2, couple of reference marks printed with the printer or sewn with the embroidery sewing machine is detected by the image sensor. Such configuration requires the image sensor to be provided at the terminating end of the arm of the embroidery sewing machine, consequently increasing the size and the manufacturing cost of the embroidery sewing machine.

Reference 2 further requires correction of the printing data and embroidery data based on the couple of printed/sewn reference marks detected by the image sensor. Such configuration requires complex and voluminous correction programs for correcting the orientation (disposition) of the image pattern and the embroidery pattern, leading to cost increase of the data processor.

SUMMARY

An object of the present disclosure is to thermally transfer an image pattern printed on a thermal transfer sheet onto a workpiece cloth and to facilitate precise positioning of the image pattern relative to an embroidery pattern which is sewn afterwards with an embroidery sewing machine.

In one aspect, a data processor that processes embroidery data for sewing an embroidery pattern on a workpiece cloth held by an embroidery frame attached to an embroiderable sewing machine, and printing data for printing an image pattern with a printer to be transferred onto the workpiece cloth through a thermal transfer sheet, the data processor including a printing data processor that includes reference-mark printing data for printing a reference mark with the printer on a back side of the thermal transfer sheet, the reference mark being used for positioning the workpiece cloth relative to the embroidery frame, and a print position specifier that specifies printing position of the image pattern relative to the reference mark, the image pattern being printed on a front side of the thermal transfer sheet; and an embroidery data processor that includes a sew position specifier that specifies sew position of the embroidery pattern relative to the reference mark.

According to the above described configuration, relative positioning between the image pattern, the embroidery pattern, and the reference mark is determined through the transfer sheet. That is, printing position of the image pattern printed on the front side of the transfer sheet and the sew position of the embroidery pattern are relatively determined based on the reference mark printed on the back side of the transfer sheet. Further, the workpiece cloth is set to the embroidery frame so that the embroidery frame conforms to the reference mark. Thus, the embroidery pattern can be readily sewn on the predetermined location of the image pattern through the reference mark, in other words, the embroidery frame to extensively simplify the positioning of the embroidery pattern relative to the image pattern.

In another aspect, a computer readable medium that stores a data processing program for processing embroidery data for sewing an embroidery pattern on a workpiece cloth held by an embroidery frame attached to an embroiderable sewing machine, and printing data for printing an image pattern with a printer to be transferred onto the workpiece cloth through a thermal transfer sheet, the data processing program stored in the computer readable medium including instructions for preparing reference-mark printing data for printing a reference mark on a back side of the thermal transfer sheet with the printer, the reference mark being used for positioning the workpiece cloth relative to the embroidery frame; instructions for specifying positioning of the image pattern relative to the reference mark, the image pattern being printed on a front side of the thermal transfer sheet; and instructions for specifying positioning of the embroidery pattern to be sewn relative to the reference mark.

Thus, by executing the data processing program stored in the medium with a computer, the aforementioned effects provided by the data processor can be obtained.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

A data processor and a data processing control program stored in a computer readable medium of the present disclosure allow positioning of image patterns and embroidery patterns to be set though adjustment in positioning of the image patterns and embroidery patterns shown on a display of the data processor. The data processor and computer readable medium further allow printing/sewing of image/embroidery patterns at their set positions.

Figure 1:
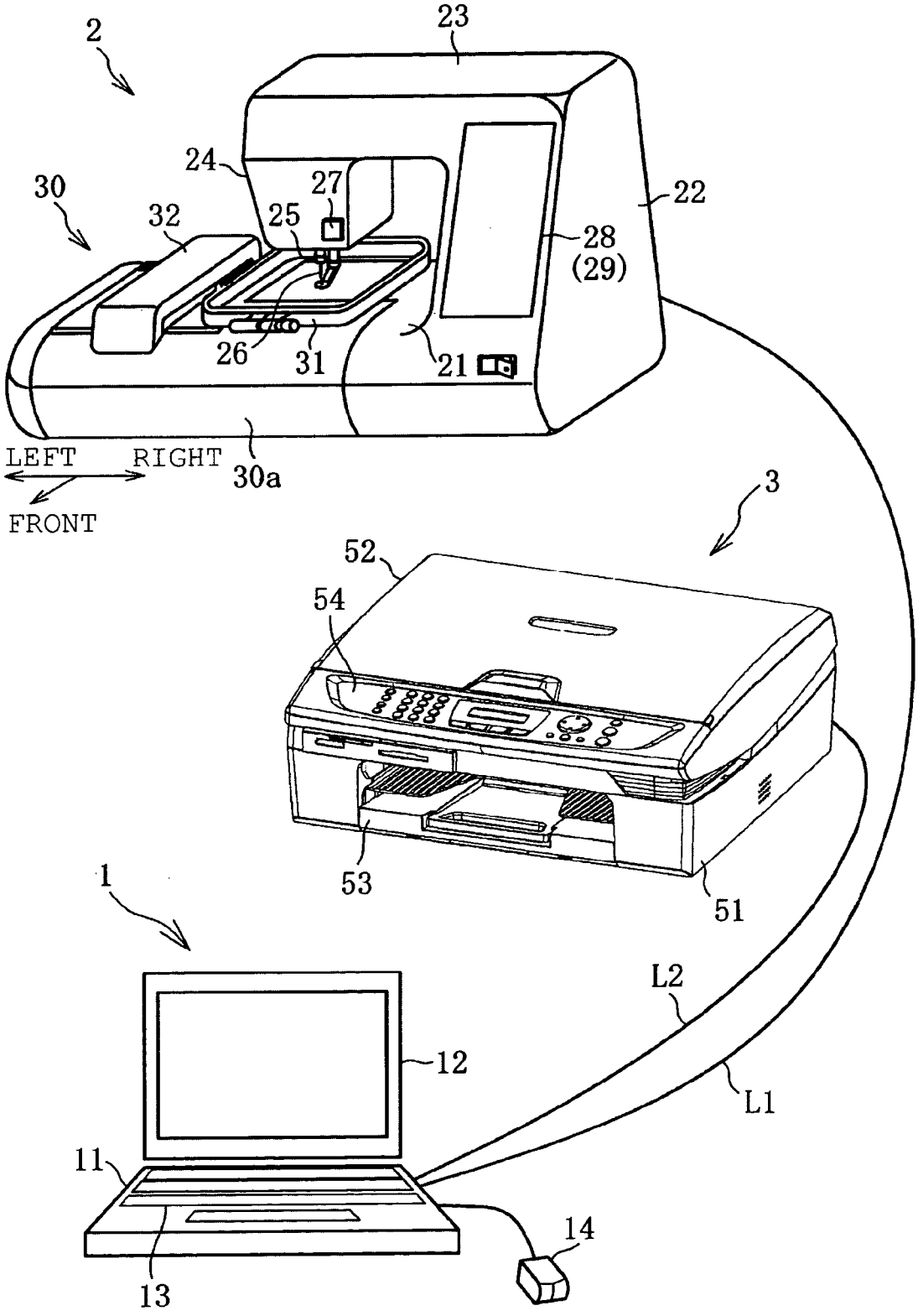
FIG. 1 depicts an exemplary embodiment of the present disclosure in which a data processor, an embroidery sewing machine, and a printer are interconnected.

One exemplary embodiment of the present disclosure will be described with reference to the drawings. Referring to FIG. 1, data processor 1 is connected to an embroidery sewing machine 2 through interconnect L1 and to a printer 3 through interconnect L2. Thus, by transmitting embroidery data generated at data processor 1 to embroidery sewing machine 2 through interconnect L1, embroidery patterns can be sewn by embroidery sewing machine 2. Likewise, by transmitting printing data generated at data processor 1 to printer 3 through interconnect L2, image patterns can be printed on various types of sheets stored in a feed cassette 53.

A description will be given hereinafter on data processor 1 comprising a microcomputer.

Referring again to FIG. 1, data processor includes components such as a PC controller 11, a display 12, a keyboard 13, and a mouse 14. Data processor 1 is in data communication with embroidery sewing machine 2 and printer 3 through interconnects L1 and L2 respectively.

Figure 2:
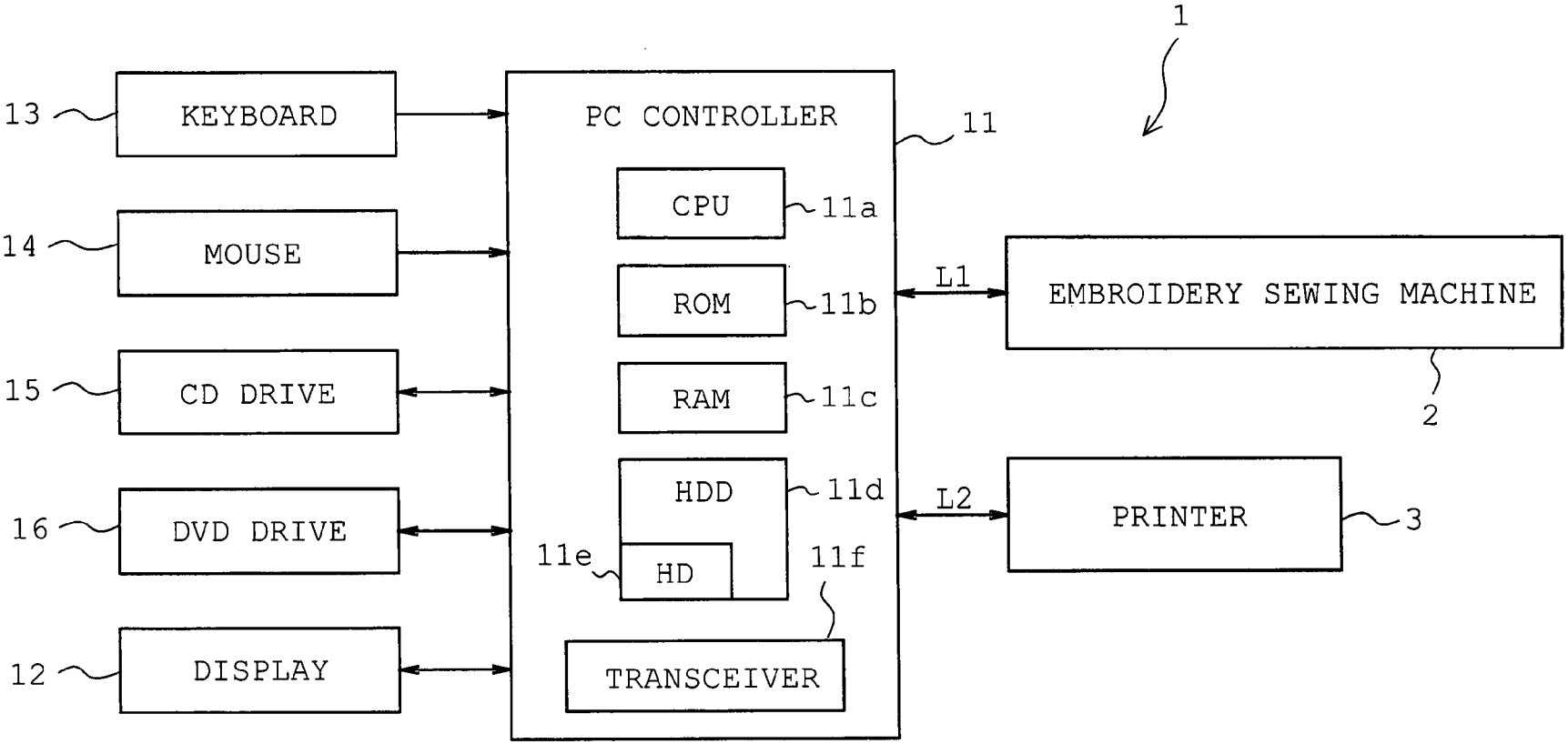
FIG. 2 is a block diagram of a control system of the data processor.

Referring now to FIG. 2, PC controller 11 includes a CPU 11*a*, a ROM 11*b*, a RAM 11*c*, a hard disc drive (HDD) 11*d* having a hard disc (HD) 11*e*, a transceiver 11*f*, a microcomputer including a bus (not shown) for interconnecting the foregoing components, and a CD drive 15 and a DVD drive 16 connected to the bus. PC controller 11 is connected to components such as a keyboard 13, a mouse 14, and display 12.

Transceiver 11*f* is a communicating element capable of transmitting various embroidery data to sewing controller 35 provided at embroidery sewing machine 2. Transceiver 11*f* is further capable of transmitting various printing data to a print controller 60 provided at printer 3. ROM 11*b* stores various programs such as a startup program for starting PC controller 11 when power of PC controller 11 is turned on. Hard disc 11*e* stores an operating system (OS) and various drivers for enabling components such as, display 12, keyboard 13, and mouse 14.

Hard disc 11*e* pre-stores data such as printing data and embroidery data and also programs such as a data processing control program constituting the features of the present disclosure. Among the printing data stored in hard disc 11*e* is a reference-mark printing data for printing a reference mark shown as an frame print SW (refer to FIG. 5) representing an embroidery frame 31 attached to embroidery sewing machine 2. Another type of printing data stored in hard disc 11*e* is image-pattern printing data for printing user defined image patterns shown as an image pattern PM (a tree in the present exemplary embodiment) on a workpiece cloth such as a T-shirt. Lastly, embroidery data stored in hard disc 11*e* is used for sewing embroidery patterns shown as an embroidery pattern SM (a star in the present exemplary embodiment) on workpiece cloth such as a T-shirt.

Figure 5:
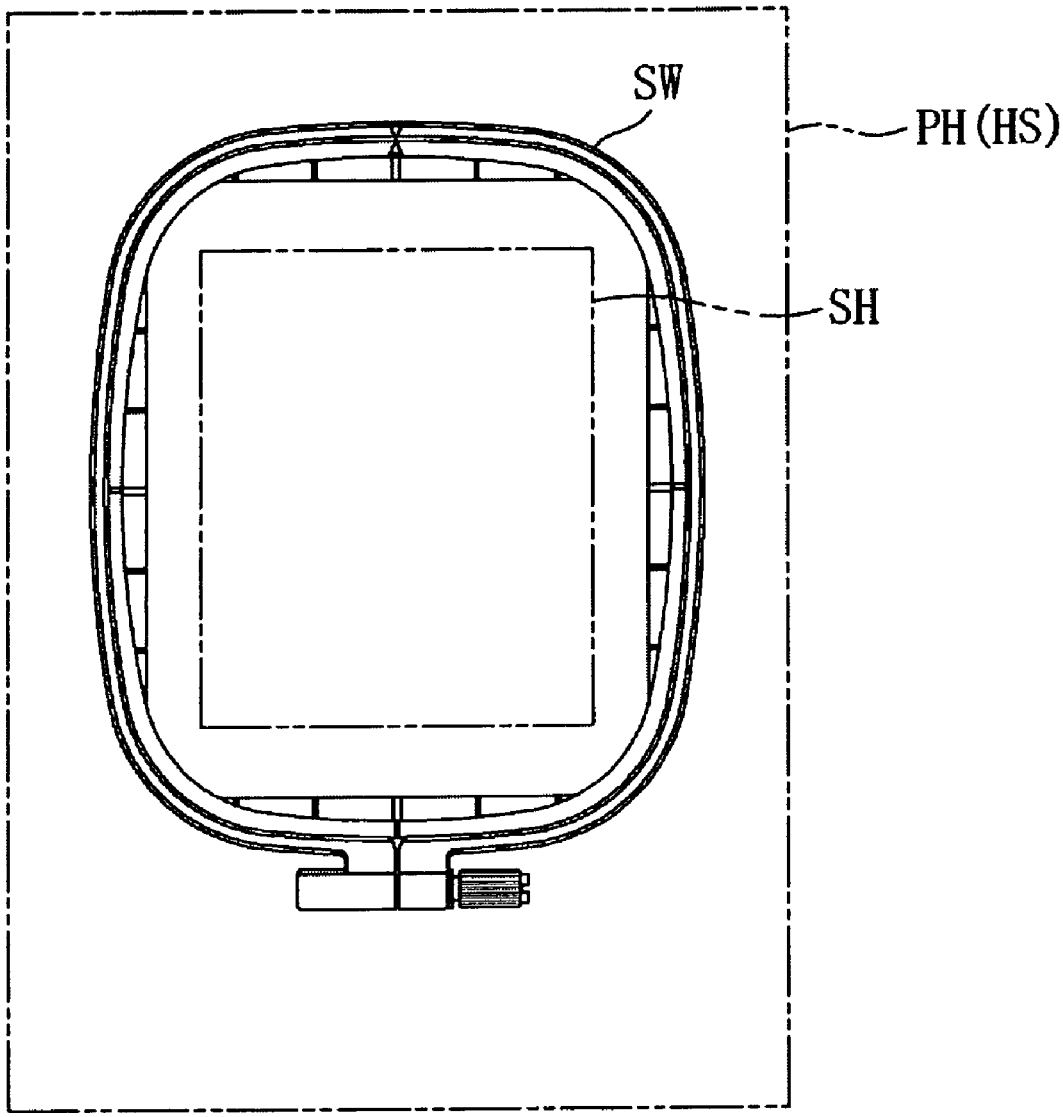
FIG. 5 is descriptive view describing positioning of frame print relative to printing range.

Referring to FIG. 5, frame-print printing data for printing frame print SW is configured by multiplicity of pixels located substantially at the center of a printing range PH (sized for example at A4 indicated in double-dot chain line) spanning the size of transfer sheet HS (thermal transfer sheet). Embroidering range SH indicated by double-dot chain line is defined within frame print SW.

Figure 6:
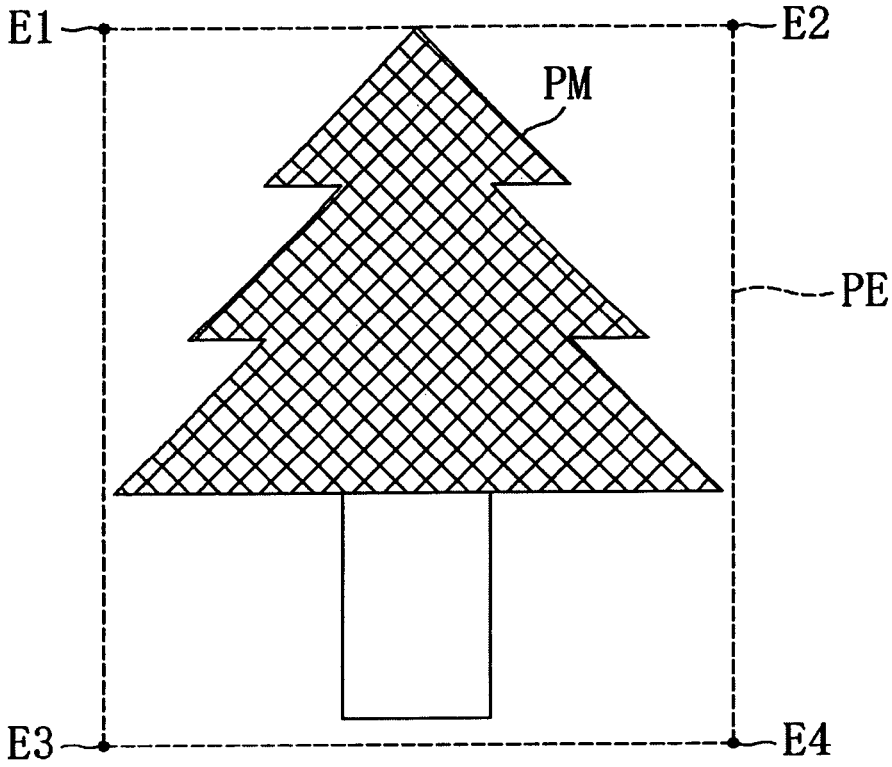
FIG. 6 is a descriptive view describing an image pattern to be printed and its printing area.

Referring to FIG. 6, printing data for printing image pattern PM (a tree, for example) is configured by multiplicity of pixels residing within a rectangular printing area PE defined by four outline points E1 to E4 and enclosing image pattern PM within it. Printing area PE resides within the bounds of printing range PH.

Figure 7:
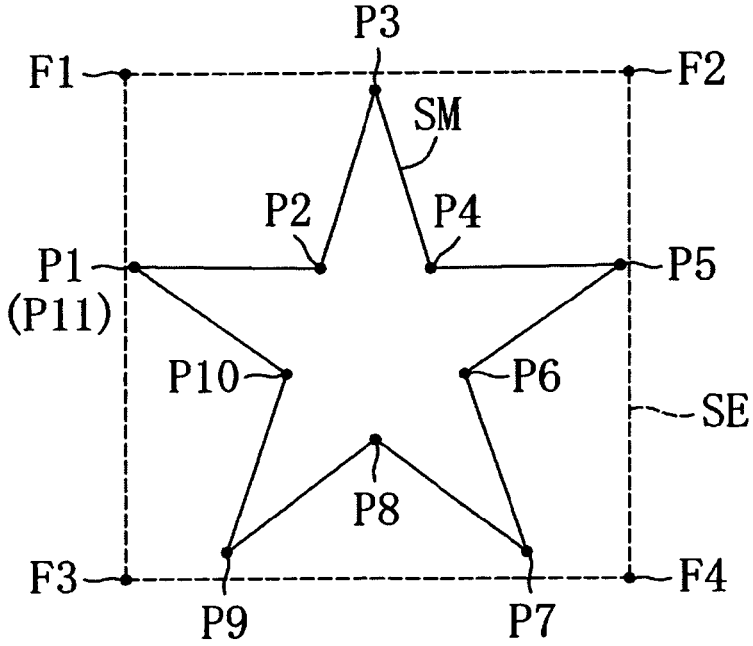
FIG. 7 is a descriptive view describing an embroidery pattern and its embroidering area.

Referring to FIG. 7, embroidery data for sewing embroidery pattern SM (a star, for example) includes location data of outline points P1 to P11 of the star, attributes such as "stitch type: tatami stitch", "stitch angle: 45 degrees", "stitch density: 5" and "stitch pitch: 3", and area data indicating a rectangular embroidering area SE (pattern enclosing area) defined by four outline points F1 to F4. The area data indicating embroidering area SE is limited within the bounds of printing range SH.

Next, a description will be given on embroidery sewing machine 2 (embroiderable sewing machine).

Referring to FIG. 1, embroidery sewing machine 2 is capable of sewing embroidery patterns shown as embroidery pattern SM in the present exemplary embodiment by attachable/detachable attachment of a later described embroidery frame transfer mechanism 30. Embroidery sewing machine 2 has a bed 21, a pillar 22 standing on the right end of bed 21, and an arm 23 extending over bed 21 from the upper end of pillar 22.

Bed 21 includes components such as a feed dog vertically moving mechanism (not shown) that vertically moves a feed dog (not shown), a feed dog longitudinally moving mechanism (not shown) that moves the feed dog longitudinally, and a loop taker (such as a horizontal shuttle) containing a bobbin thread bobbin and operating in cooperation with a sewing needle 6. Arm 23 includes components such as a needle-bar drive mechanism (not shown) that vertically moves a needle bar 25 having sewing needle 26 attached on its lower end, and a needle-swing mechanism (not shown) that swings needle bar 25 in a direction orthogonal to a direction of cloth feed, a thread take-up drive mechanism (not shown) that vertically moves the thread take-up (not shown) in synchronization with the vertical movement of needle bar 25.

One extreme end of arm 23 defines a head 24 which is provided with a start/stop switch 27 being manually operated to instruct starting and stopping of a sewing operation. The feed dog vertically moving mechanism, the feed dog longitudinally moving mechanism, needle-bar drive mechanism, and the thread take-up drive mechanism are driven by a sewing machine motor 38 respectively. The needle-bar swing mechanism is driven by a needle-swing motor 39 (refer to FIG. 3).

On the front face of pillar 22, a color liquid crystal display 28 (hereinafter referred to as LCD 28) is provided for displaying images of different types of stitch patterns such as utility patterns and embroidery patterns as well as various function names, pattern names and messages. On the front face of LCD 28, a touch panel 29 having touch keys (not shown) comprising transparent electrodes are provided for allowing operations such as selection of various functions and specifying various settings such as adjustment of sewing speed. Touch key operation will not be described in detail.

On the left side-end of bed 21, a free bed (not shown) is formed which is generally referred to as a free arm. The Free bed allows attachable/detachable attachment of embroidery-frame transfer mechanism 30 as shown in FIG. 1. Embroidery-frame transfer mechanism 30 comprises a body case 30*a*, a carriage 32, a Y-directional transfer mechanism contained in carriage 32 and an X-directional transfer mechanism contained in body case 30*a*. Y-directional transfer mechanism drives embroidery frame 31 releasably retaining workpiece cloth such as a T-shirt in the Y-direction (longitudinal direction). X-directional transfer mechanism drives carriage 32 in the X-direction (lateral direction).

Figure 3:
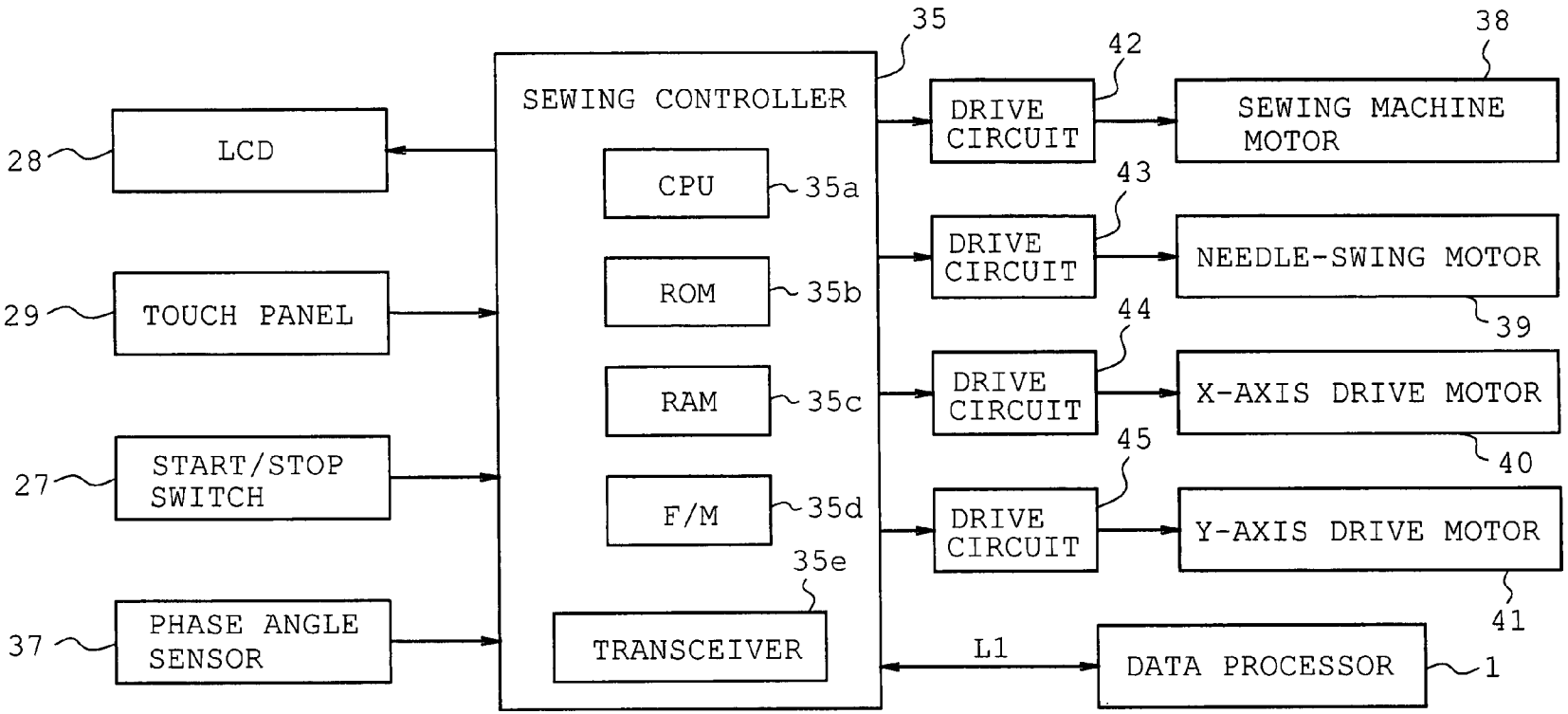
FIG. 3 is a block diagram of a control system of the embroidery sewing machine.

X-directional transfer mechanism is driven by an X-axis drive motor 40; whereas Y-directional transfer mechanism is driven by a Y-axis drive motor 41 (refer to FIG. 3). X-axis drive motor 40 and Y-axis drive motor 41 are controlled by a sewing controller 35 provided at embroidery sewing machine 2. Attachment of embroidery-frame transfer mechanism 30 on the free bed establishes electric connection between sewing controller 35 and X-axis and Y-axis drive motors 40 and 41. The above described configuration allows embroidery frame 31 set with the workpiece cloth to be driven independently in the X-direction and the Y-direction. Embroidery frame 31 may be any embroidery frame generally used in the art that clamps the workpiece cloth with an inner frame and an outer frame.

Next, a description will be given on a control system of embroidery sewing machine 2.

Referring to FIG. 3, sewing controller 35 is configured by components such as a microcomputer comprising a CPU 35*a*, a ROM 35*b*, a RAM 35*c*, and a flash memory (F/M) 35*d*, and a transceiver 35*e*. Transceiver 35*e* is a communicating element in data communication with PC controller 11 of data processor 1 for exchanging various data.

Sewing controller 35 establish connections with, LCD 28, touch panel 29, start/stop switch 27, a phase angle sensor 23 that senses rotational phase angle of a main shaft, drive circuits 42, 43, 44, and 45 that drive sewing machine motor 38, needle-swing motor 39, X-directional drive motor 40, and Y-directional drive motor 41. Sewing controller 35 is connected to data processor 1 through connection line L2.

ROM 35*b* of sewing controller 35 pre-stores control programs for controlling the sewing operation through control of each type of motors 38 to 41. RAM 35*c* allocates various memory for data storage purposes and various buffers, counters, memory, and the like, for temporary storage of calculation result produced by CPU 35*a*.

A description will be given hereinafter on an ink jet printer 3.

Printer 3 is a multi function device (MFD) having printing, copying, scanning and facsimile transmission capabilities. Printer 3 is capable of printing (recording) on materials such as sheet of paper or plastic film, transfer sheet HS described in detail afterwards, and other types of sheets. Printer 3, when in facsimile mode, performs image recording in monochrome; whereas in printing and copying mode, performs image recording in color and monochrome.

Referring to FIG. 1, printer 3 contains a scanner mechanism which is accessible through openable/closable cover 52 provided over the top of body case 51. Below the scanner mechanism, a recording mechanism (not shown) is provided for recordation of sheets by the above described functional modes. A feeder (not shown) is provided at the bottom interior of body case 51.

Recording mechanism includes a carriage and a carriage transfer mechanism. The carriage contains a recording head 68 (refer to FIG. 4) for printing various color images and is reciprocated by the carriage transfer mechanism in the lateral direction which is the direction in which main scan is performed. The recording mechanism operates such that recording head 68 contained in the carriage is controlled to reciprocate laterally in the direction of main scan by a print controller 60 (refer to FIG. 4). While reciprocating in the main scan direction, recording head 68 discharges four color of ink from either of its multiplicity of nozzles. Color images are printed on recording sheets fed below recording head 68 in the above described manner.

Though not shown, the carriage rests in a standby position before and after the printing operation. A maintenance unit is provided in the standby position to execute various maintenance operations such as wiping to clean the nozzle faces of recording head 68 by a blade or the like, purging to forcibly remove dust, air and solidified ink from the nozzle, and flushing.

In the front side interior of body case 51, four ink cartridges (not shown) neighboring in alignment are provided for printing (recording) images in full color. Each cartridge contains either of the four colors namely, black, cyan, magenta, and yellow, and is separately detachable/attachable from body case 51. Ink stored in each ink cartridge is supplied to the dedicated recording head 68 through a dedicated supply tube by a pump (not shown).

On the back side of body case 51, a guide path is defined to guide the recording sheets to the recording mechanism from the back side of the feeder. The feeder is provided with a feed cassette 53 for storing the recording sheets. The recording sheets stored in feed cassette 53 are fed one by one to the recording mechanism via the path by rotation of a feed roller driven by a feed motor 65 (refer to FIG. 4).

Figure 4:
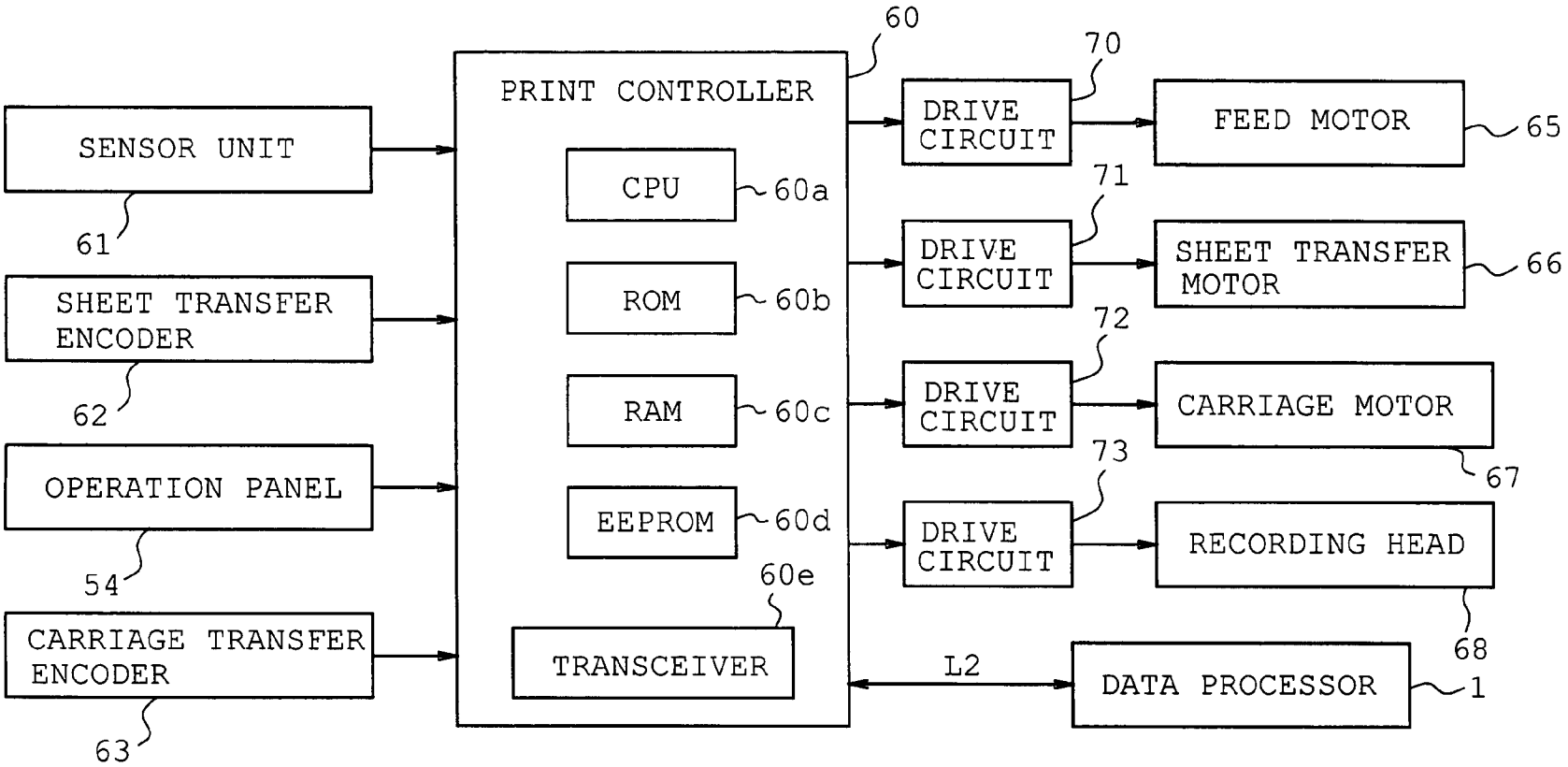
FIG. 4 is a block diagram of a control system of the printer.

The recording mechanism has a transfer roller adjacent the exit of the guide path which is driven by a transfer motor 66 (refer to FIG. 4). After image patterns have been printed on the recording sheets, the printed sheets are fed out by a discharge roller. Feed cassette 53 allows storage of the aforementioned transfer sheet HS in addition to recording sheets of various sizes such as A4 and A5. Transfer sheet HS comprises a thin heat-resistive sheet made of urethane resin and is also referred by names such as an iron transfer sheet or iron print sheet.

On the upper front surface of printer 3, an operation panel 54 comprising user operable buttons and a liquid crystal panel is provided. Operation panel 54 allows user selection of modes such as printing mode, copying mode, scanning mode, and facsimile mode, customization of settings for each mode, accepts user inputs such as facsimile numbers, and provides operational status and communication history.

Print controller 60 of printer 3 will be described with reference to FIG. 4.

Print controller 60 comprises a microcomputer including a CPU 60*a*, a ROM 60*b*, RAM 60*c*, EEPROM 60*d*, and a transceiver 60*e*. Print controller 60 establishes electric connections with a sensor unit 61, a sheet transfer encoder 62, operation panel 54, and carriage transfer encoder 63. Sensor unit 61 includes a well known media sensor or resist sensor capable of sensing presence/absence of recording sheets stored in feed cassette 53, and sensing the edges of the four sides of the recording sheets. Encoder 62 senses the amount (position) of transfer of the recording sheets.

Print controller 60 further establishes connection with drive circuits 70, 71,72, and 73 for driving a feed motor 65, transfer motor 66, carriage motor 67, and recording head 68. Each of the above described mechanism is controlled by CPU 60*a* through control of drive circuits 70 to 73 based on each control program stored in ROM 60*b* and EEPROM 60*d*.

Figure 8:
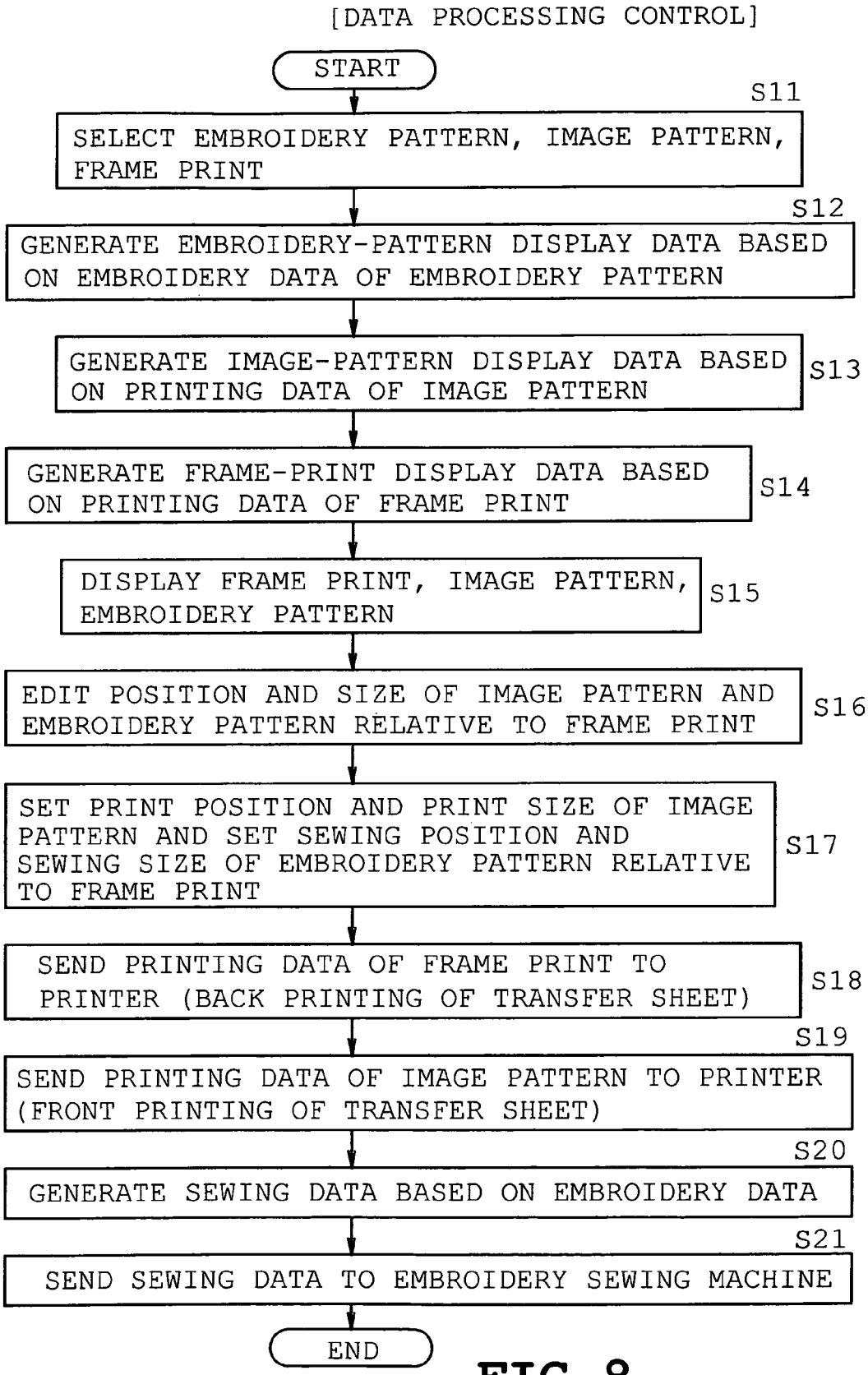
FIG. 8 is a flowchart of a data processing control.

Next, data processing control executed by PC controller 11 of data processor 1 will be described with reference to the flowchart indicated in FIG. 8.

The data processing control is started when the user presses a "print/embroider key" on keyboard 13. As the first step of the data processing control, a pattern selection screen is shown on display 12. Responsively, the user selects the desired embroidery pattern SM and image pattern PM to be sewn/printed on workpiece cloth such as a T-shirt, and an frame print SW which is identical in type and size as embroidery frame 31 attached to embroidery frame transfer mechanism 30 of embroidery sewing machine 2 (S11).

Then, based on the embroidery data of the embroidery pattern selected at S11, embroidery-pattern display data is generated (S12). Based on embroidery data comprising position data of outline points P1 to P11 and attribute data, the area within the outline defined by the outline points are colored by the specified color of embroidery thread to generate the embroidery-pattern display data. Alternatively, embroidery-pattern display data may be generated by calculating the multiplicity of needle drop position data and converting each needle drop position into pixels as done when forming stitches.

Then, based on the image-pattern printing data of image pattern PM selected at S11, image-pattern display data is generated (S13). In generating the image-pattern display data, each of the multiplicity of dot data constituting the image-pattern printing data is converted into pixels for displaying purposes.

Then based on frame-print printing data of frame print SW selected at S11, frame-print display data is generated (S14). Frame print SW is drawn by a solid line and thus, in order to generate the frame-print display data, multiplicity of dot data constituting the frame-print printing data is converted into pixels which are sequentially connected to define a closed-loop outline.

Display 12 shows embroidery pattern SM based on embroidery-pattern display data generated at S12, image pattern PM based on image-pattern display data generated at S13, and frame print SW based on frame-print display data generated at S14 (S15). When embroidery pattern SM and image pattern PM overlap, embroidery pattern SM is displayed on foreground and image pattern PM on background. When image pattern PM and frame print SW overlap, image pattern PM is displayed on foreground and frame print SW on background. However, the user may be allowed to switch the foreground-background relation.

Based on the view provided by display 12, the user may edit the print position and the print size of image pattern PM relative to frame print SW. Likewise, the user may edit the sew position and the sew size of embroidery pattern SM relative to frame print SW (S16). More specifically, editing is carried out through display 12 by rearranging the positioning and expanding/shrinking the sizing (print size) of image pattern PM by controlling a pointer PT (refer to FIG. 9) shown on display 12 in response to movement of mouse 14 and left/right click operations. Likewise, editing is carried out through display 12 by rearranging the positioning and expanding/shrinking the sizing (sew size) of embroidery pattern SM by controlling pointer PT shown on display 12 in response to movement of mouse 14 and left/right click operations.

Upon completion of editing at S16, based on positioning and sizing of image pattern PM shown on display 12, print position and print size of image pattern PM relative to frame print SW is determined within the limitation of a printing range PH. Likewise, based on positioning and sizing of embroidery pattern SM shown on display 12, sew position and sew size of embroidery pattern SM relative to frame print SW is determined within the limitation of an embroidering range SH (S17).

Then, the user is to place transfer sheet HS back side up into feed cassette 53 and set feed cassette 53 into printer 3. When the user presses the "print key" on keyboard 13, frame-print printing data of frame print SW is transmitted to printer 3 (S18). Responsively, frame print SW is printed in "red", for example, on the backside of transfer sheet HS fed into recording mechanism.

Next, the user is to again, place transfer sheet HS face up into feed cassette 53 so that frame print SW printed on its backside does not show, and set cassette 53 to printer 3. Then, when the user presses the "print key" again, printing data of image pattern PM edited at S16 is turned over so that its left and right are reversed, and the image-pattern printing data is thereafter transmitted to printer 3 (S19). As a result, image pattern PM is printed on the front side of transfer sheet HS fed to the recording mechanism with the specified color. Transfer sheet HS to be transferred on T-shirt TS is prepared in the above described manner.

Next, the user is to place transfer sheet HS face down onto the front side or the back side of T-shirt TS with image pattern PM facing T-shirt TS. Then, after pressing an iron heated to approximately 180 degrees Celsius onto transfer sheet HS for a few seconds, transfer sheet HS is left to cool to atmospheric temperature. As a result, image pattern PM printed on transfer sheet HS is transferred onto the intended position of the front/back side of T-shirt TS with proper left and right positioning.

Then, the user is to attach T-shirt TS to embroidery frame 31 without removing transfer sheet HS. At this time, T-shirt TS is retained (clamped) by embroidery frame 31 such that frame print SW printed on the back side of transfer sheet HS conforms to the actual embroidery frame 31. Then, the user attaches embroidery frame 31 to embroidery sewing machine 2 to complete preparatory work.

When "sew key" on keyboard 13 is operated by the user after completing the preparatory work, sewing data (stitch data) comprising multiplicity of needle drop position data is generated based on embroidery data edited at S16 (S20). Sewing data generation process, being well known in the art, will not be described in detail. Next, the generated sewing data is transmitted to embroidery sewing machine 2 (S21).

When start/stop switch 27 is operated to start embroidery sewing machine 2, embroidery sewing machine 2 sews embroidery pattern SM based on embroidery data in proper predetermined positioning relative to image pattern PM. Embroidery frame 31 is removed from embroidery sewing machine 2 when sewing operation has been completed. Then, T-shirt TS is removed from embroidery frame 31 and transfer sheet HS is peeled off of T-shirt TS. Thus, image pattern PM is printed on the front/back side of T-shirt TS and embroidery pattern SM is sewn in the predetermined positioning relative to image pattern PM.

Next, the operation of the present exemplary embodiment is described through an exemplary sewing operation. In this example, image pattern PM represented as "tree" as described earlier is transferred on the front side of T-shirt TS by transfer sheet HS and embroidery pattern SM represented as "star" as described earlier is sewn at the top of image pattern PM "tree" by embroidery sewing machine 2.

When the user selects a medium size embroidery frame 31, image pattern PM represented as "tree", and an embroidery pattern SM represented as "star" respectively on display 12, printing range PH and embroidering range SH are respectively shown in "red" on display 12. Display 12 further shows the selected frame print SW, image pattern PM and its printing area PE, and embroidery pattern SM and its embroidering area SE, respectively. Of note is that embroidery pattern SM (embroidering area SE) is displayed within embroidery range SH.

Under such state, the user is allowed to edit the positioning of image pattern PM by moving mouse 14 and edit its print size (size displayed) by clicking of mouse 14 with pointer PT pointing printing area PE. Likewise the user is allowed to edit the positioning of embroidery pattern SM by moving mouse 14 and edit the embroidering size (size displayed) by clicking of mouse 14 with pointer PT pointing embroidering area SE.

Figure 9:
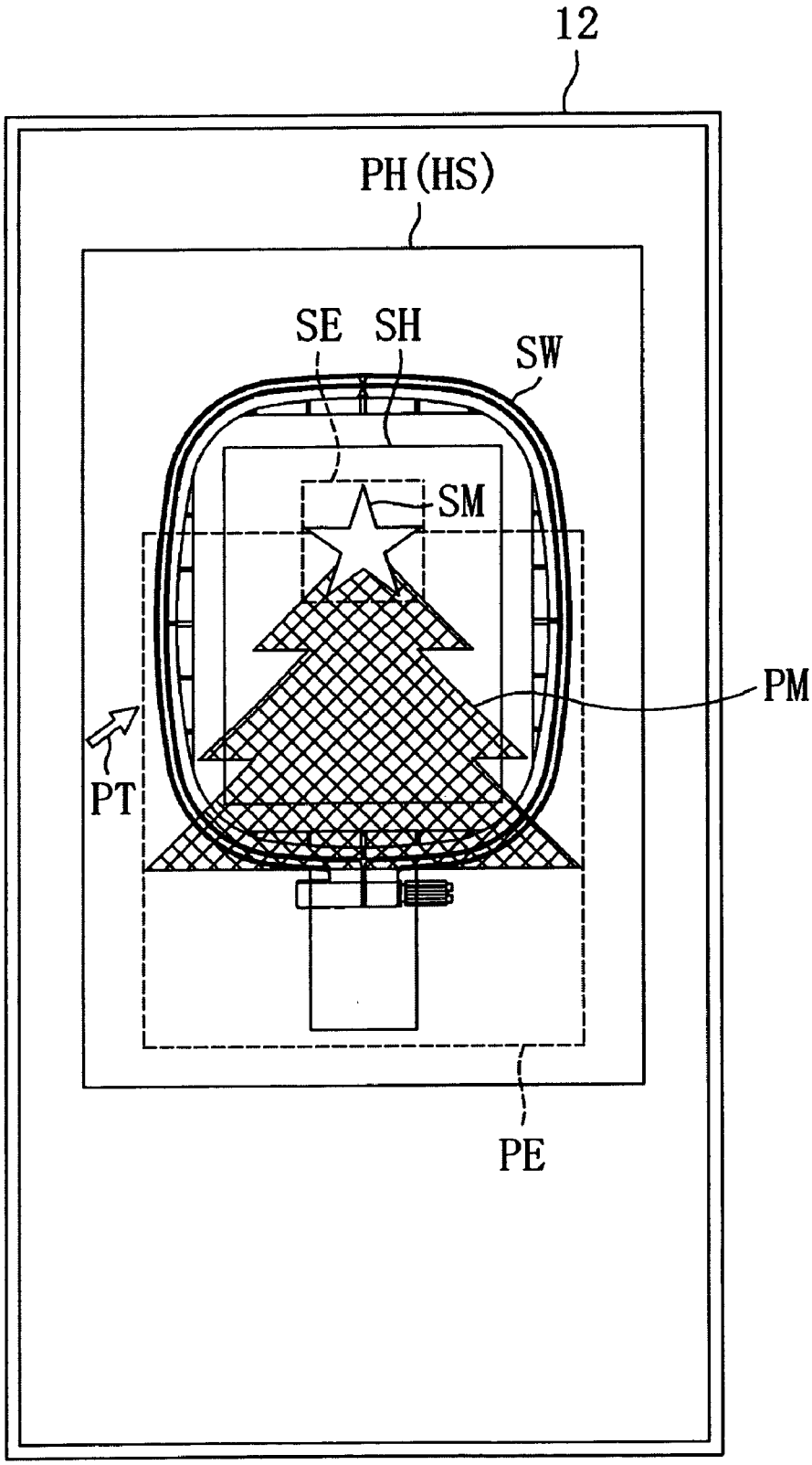
FIG. 9 is a descriptive view of describing a view shown on a display of the data processor.

As the result of editing, positioning and sizing of image pattern PM are determined as shown in FIG. 9. Likewise, positioning and sizing of embroidery pattern SM are determined. As described above, based on the result of editing though screen of display 12, print position and print size of image pattern PM relative to frame print SW are set; and likewise, sew position and sew size of embroidery pattern SM relative to frame print SW are set.

State differently, as the result of editing, data representing print position and printing area PE of image pattern PM and printing area PE within printing range PH is generated to allow printing with printer 3. Likewise, as the result of editing, data representing sew position of embroidery pattern SM and embroidering area SE within embroidering range SH is generated to allow sewing with embroidery sewing machine 2. The result of editing is stored in RAM 11*c*.

Figure 10:
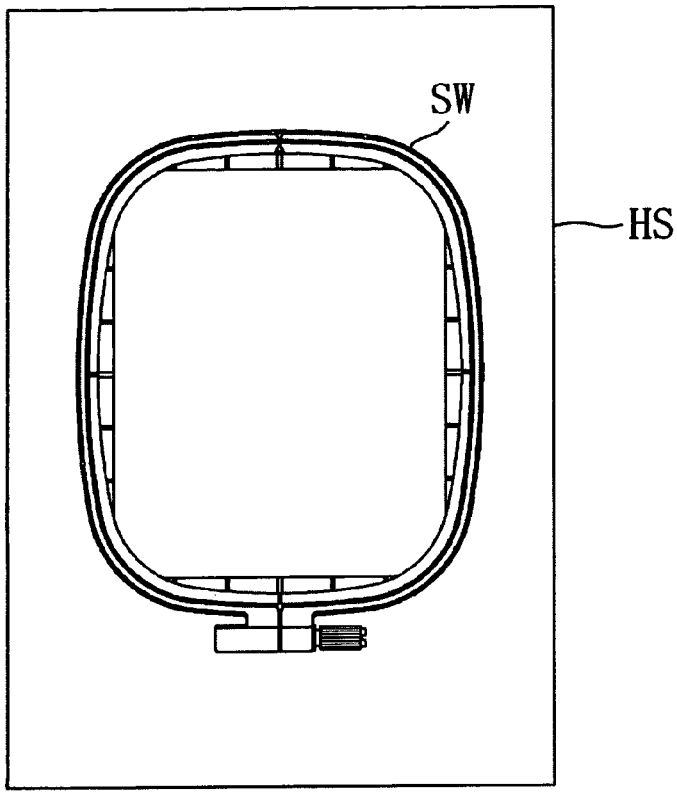
FIG. 10 depicts the frame print printed on a back side of a transfer sheet.

Next, the user is to attach feed cassette 53 containing transfer sheet HS back side up to printer 3 and operate the "print key". Responsively, frame-print printing data is transmitted to printer 3 and frame print SW is printed in "red", for instance, onto the backside of transfer sheet HS as shown in FIG. 10.

Figure 11:
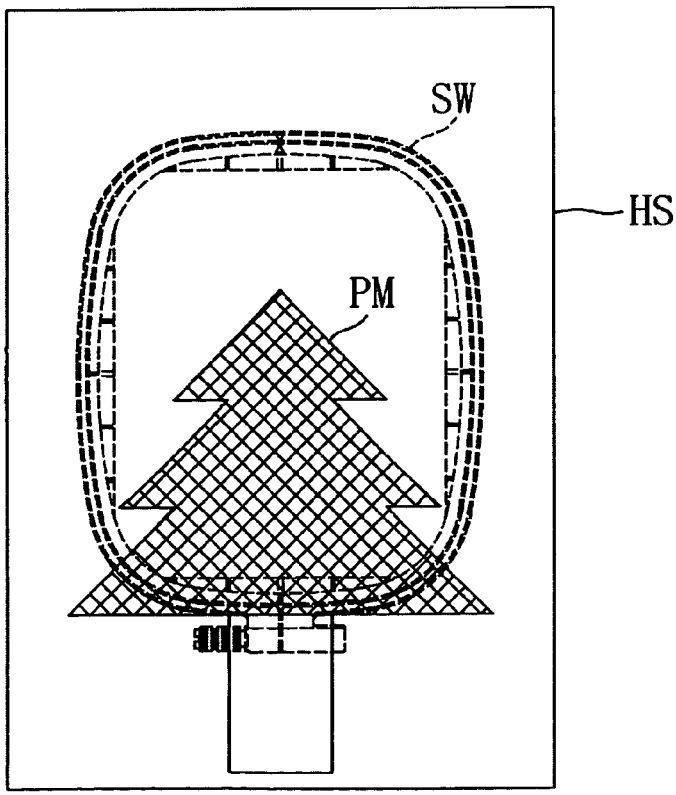
FIG. 11 depicts the image pattern being printed on a front side of the transfer sheet.

Next, the user sets transfer sheet HS face up into feed cassette 53. Feed cassette 53 is thereafter set to printer 3 and the "print key" is operated again. Thus, image pattern PM is printed on the front side of transfer sheet HS in specified color as shown in FIG. 11. At this time, image pattern PM is printed with its left and right reversed. Preparations for image transfer of transfer sheet HS is carried out in the above described manner.

Figure 12:
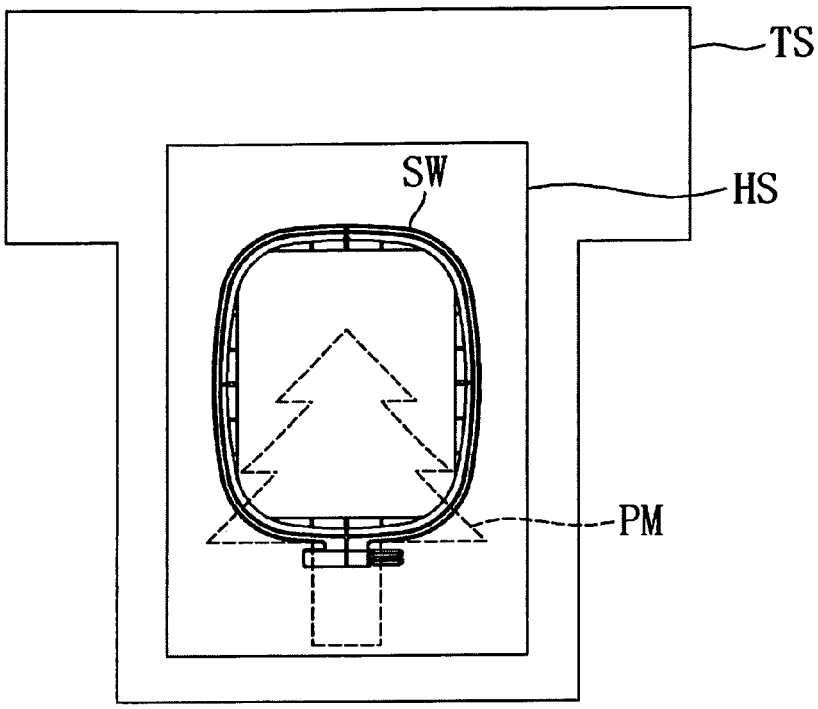
FIG. 12 is a descriptive view describing transferring of the image pattern printed on the transfer sheet to a T-shirt.

Next, the user is to place the transfer sheet HS printed on both sides onto the front side of T-shirt TS so that image pattern PM faces T-shirt TS as shown in FIG. 12. Then, transfer sheet HS is evenly pressed down with an iron for a few seconds and cooled down to atmospheric temperature.

Figure 13:
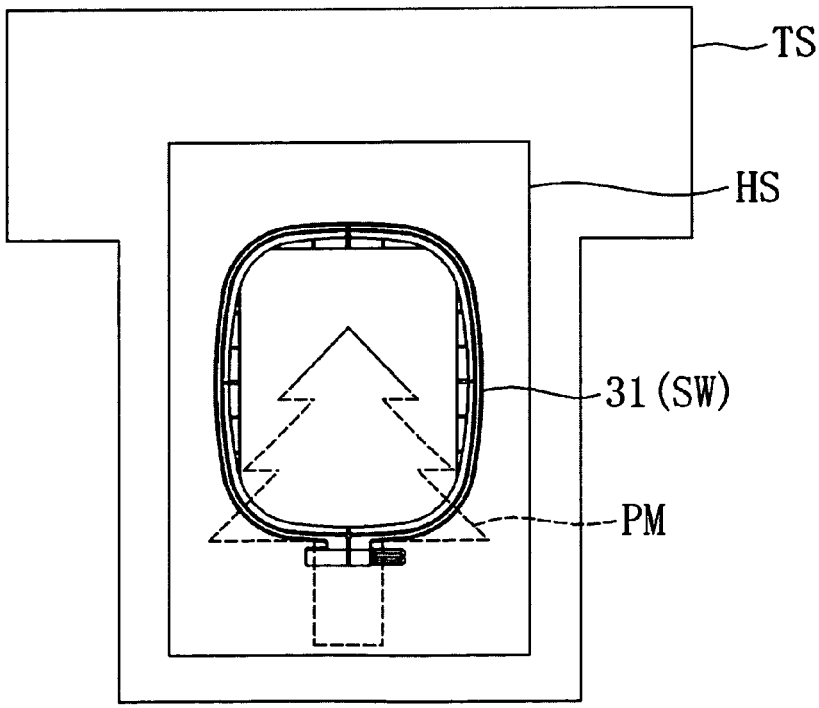
FIG. 13 is a plan view of the T-shirt held by an embroidery frame with the transfer sheet attached to it.

Then T-shirt TS is attached to embroidery frame 31 without removing transfer sheet HS as shown in FIG. 13. At this time, T-shirt TS is retained by embroidery frame 31 such that frame print SW printed on the back side of transfer sheet HS conforms to the actual embroidery frame 31. Then, the user attaches embroidery frame 31 holding T-shirt Ts with attachment of transfer sheet HS to embroidery sewing machine 2.

Figure 14:
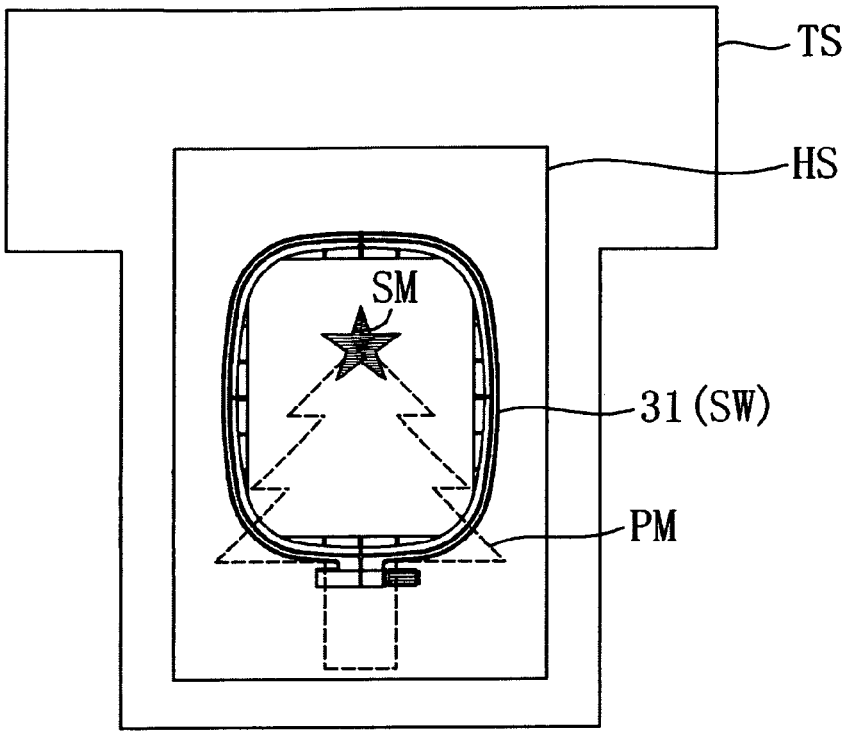
FIG. 14 is a plan view of a T-shirt with the embroidery pattern sewn on it via the transfer sheet.

When "sew key" is operated by the user, sewing data comprising multiplicity of needle drop position data is generated based on edited embroidery data and thereafter transmitted to embroidery sewing machine 2. Then, when embroidery sewing machine 2 is started by operation of start/stop switch 27, embroidery pattern SM is sewn by embroidery sewing machine 2 so as to overlap with the top of image pattern PM represented as "tree" as shown in FIG. 14.

Figure 15:
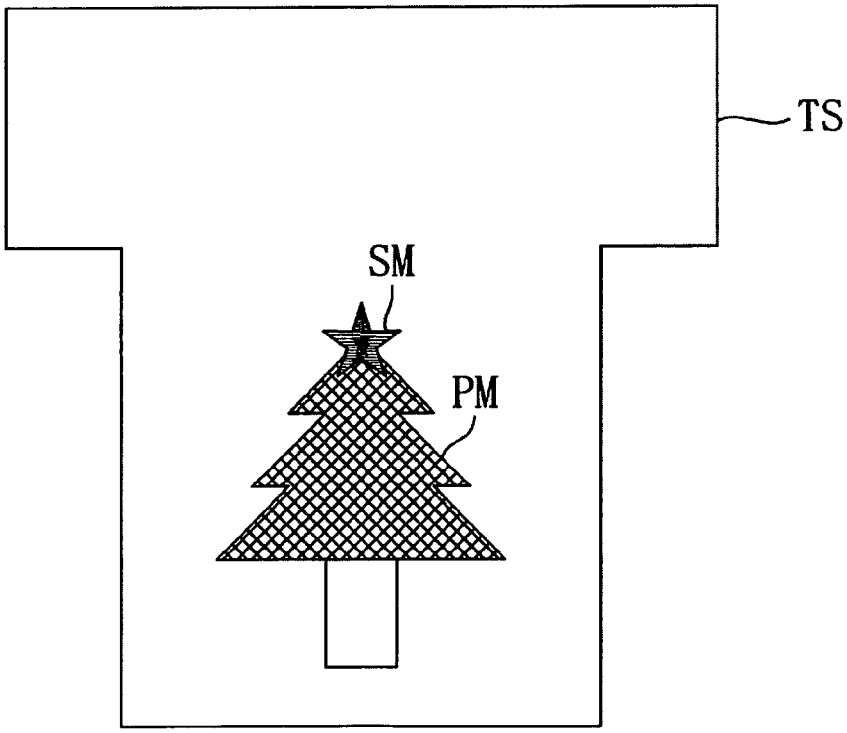
FIG. 15 is a plan view of a T-shirt having the image pattern printed on it and having the embroidery pattern sewn on it.

Then, the user is to remove embroidery frame 31 from embroidery sewing machine 2 and thereafter remove T-shirt TS being attached with transfer sheet HS from embroidery frame 31. Finally, transfer sheet HS is peeled off of T-shirt TS. Thus, image pattern PM "tree" is printed on the front side of T-shirt TS in the desired position and size and embroidery pattern SM is sewn in the predetermined position at the top of image pattern PM as shown in FIG. 15.

In the present exemplary embodiment, relative positioning is established between frame print SW, image pattern PM, and embroidery pattern SM through transfer sheet HS. More specifically, printing position of image pattern PM printed on the front side of transfer sheet HS and sew position of embroidery pattern SM are relatively determined with respect to frame print SW printed on the back side of transfer sheet HS. Further, workpiece cloth is set to embroidery frame 31 such that embroidery frame 31 conforms to frame print SW. Thus, embroidery pattern SM can be readily sewn at the predetermined position of image pattern PM through frame print SW, in other words, embroidery frame 31 to extensively simplify the positioning of embroidery pattern SM relative to image pattern PM.

Frame print SW printed on the back side of transfer sheet HS serves as a reference mark that represents embroidery frame 31 holding the workpiece cloth. Thus, the workpiece cloth can be properly positioned relative to embroidery frame 31 with greater ease since it only requires frame print SW printed on the back side of transfer sheet HS to be arranged to conform to embroidery frame 31.

Furthermore, data processing control allows editing of print size of image pattern PM and sew size of embroidery pattern SM. Thus, image pattern PM and embroidery pattern SM can be set at a given size respectively.

The data processing program constituting the features of the present disclosure which has been described above to be stored in hard disc 11*e* of data processor 1 may be stored in other various computer readable medium such as a CD-ROM, a flexible disk, a DVD, and a memory card. In such case, operation and effect described above can be achieved by reading the medium with computers provided in various types of data processors.

Description will now be given on modified exemplary embodiments.

First, a description will be given on a first modified exemplary embodiment.

Figure 16:
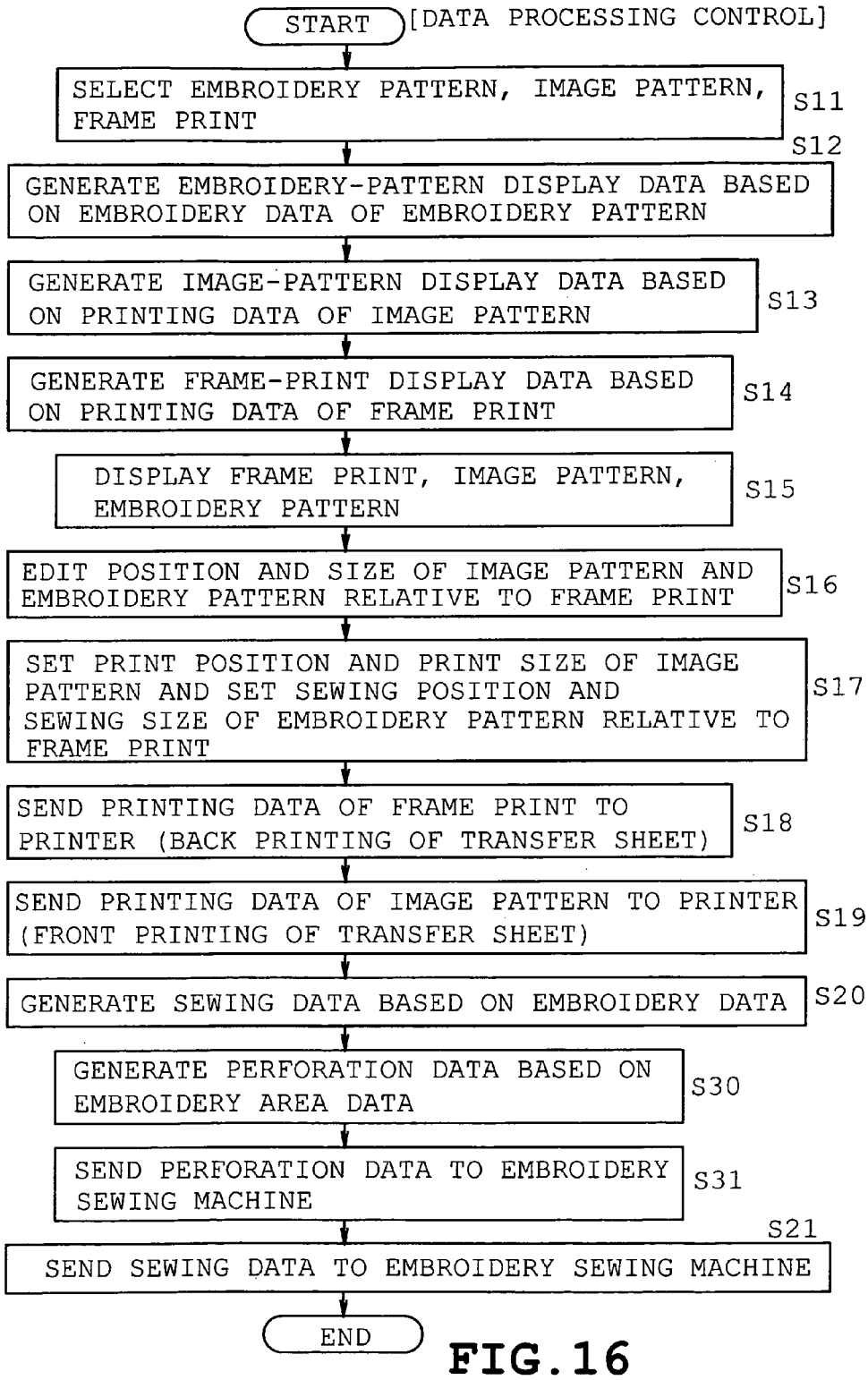
FIG. 16 corresponds to FIG. 8 and describes a modified exemplary embodiment.

Perforations may be formed to define a rectangular or polygonal pattern area that encloses an embroidery pattern SM within it. Then, an opening may be defined on transfer sheet HS along the perforations so that embroidery pattern SM is sewn in the opening. In order to realize the above modified approach, data processing control may be partially modified as shown in FIG. 16 such that steps S30 and S31 are introduced between steps S20 and S21.

Figure 17:
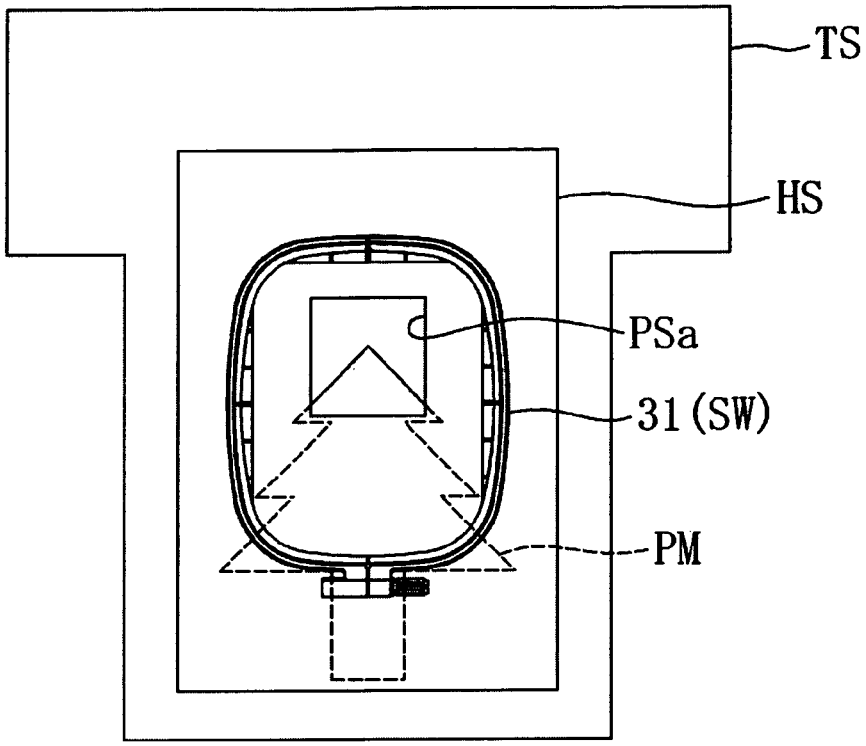
FIG. 17 corresponds to FIG. 13 with an opening formed on the transfer sheet.

More specifically, after generating the sewing data at S20, perforation data is generated (S30) for forming rectangular perforation PSa bordering the pattern area that encloses embroidery pattern SM based on embroidery data set at S17 and embroidering area data that defines embroidering area SE (refer to FIG. 7) associated with it. Then, perforation data is transmitted to embroidery sewing machine 2 (S31). Based on the transmitted perforation data, embroidery sewing machine 2 forms perforation PSa that outline the rectangular pattern area in a predetermined pitch. Then, the user partially removes transfer sheet HS along the rectangular perforation PSa formed. The partial removal of transfer sheet HS along perforation PSa by the user creates a rectangular opening on the remaining transfer sheet HS as shown in FIG. 17.

Figure 18:
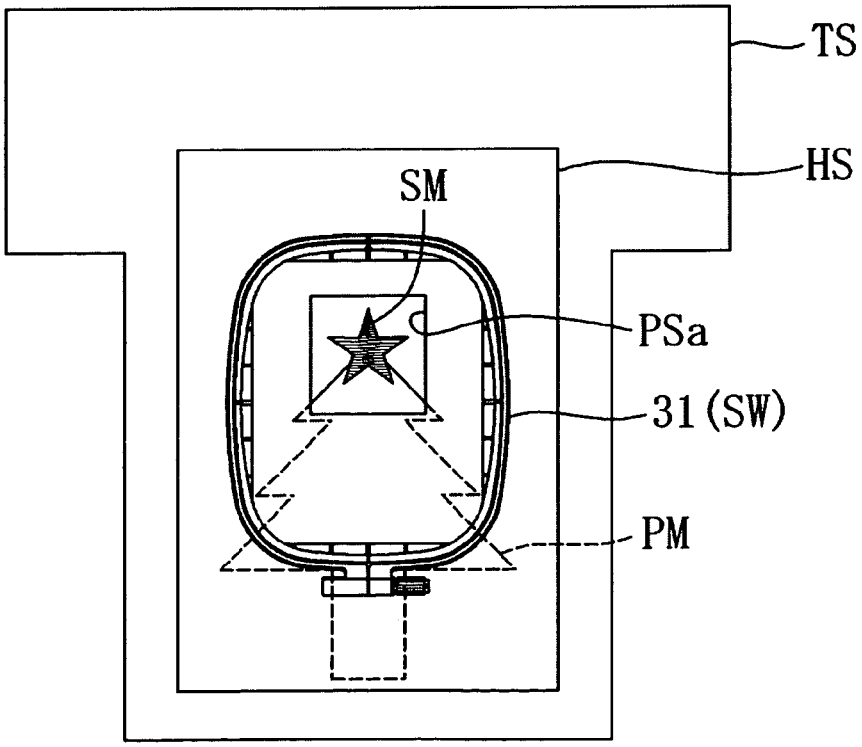
FIG. 18 corresponds to FIG. 14 with the T-shirt having the embroidery frame sewn at the opening of the transfer sheet.

Next, when the "sew key" is operated again by the user, the embroidery data edited at S16 is transmitted to embroidery sewing machine 2 (S21). Then, when embroidery sewing machine 2 is started by operating start/stop switch 27, embroidery pattern SM is sewn so as to overlap with the top of image pattern PM represented as "tree" situated within the opening defined by perforation PSa as shown in FIG. 18. Since embroidery pattern SM is sewn in the opening of transfer sheet HS, transfer sheet HS can be neatly removed in a quick and easy manner.

As described above, perforation PSa is defined so as to outline the rectangular pattern area that encloses embroidery pattern SM based on perforation data. Thus, embroidery pattern SM can be sewn directly on workpiece cloth within the pattern area after removing transfer sheet HS along perforation PSa. Further, perforation PSa allows transfer sheet HS to be neatly removed with greater ease after embroidering has been completed.

Next, a description will be given on a second modified exemplary embodiment.

Figure 19:
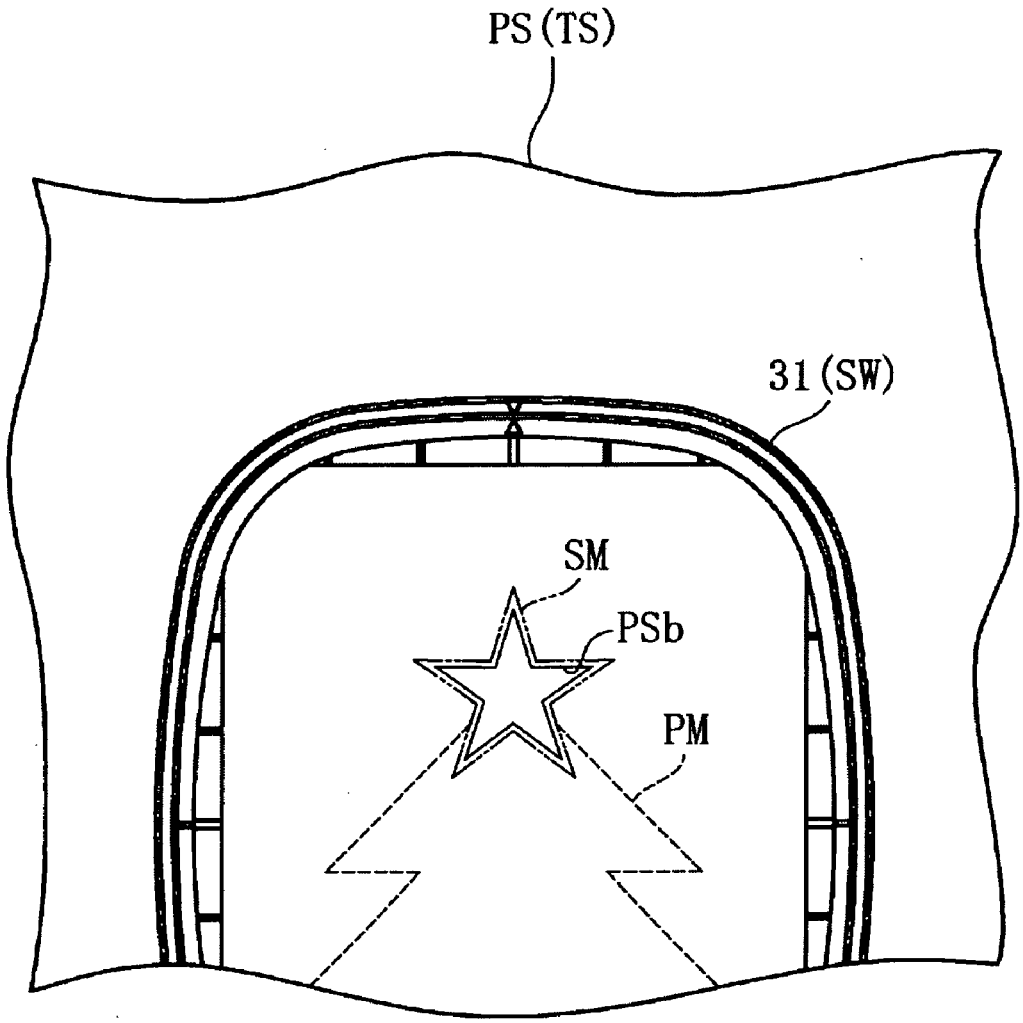
FIG. 19 is an enlarged view of the opening formed in a star shape on the transfer sheet.

The perforation data formed at S30 of data processing control may be alternatively formed by calculation based on embroidery data of embroidery pattern SM "star". In such case, perforation PSb may be generated along a thin line depicted immediately within the outline of embroidery pattern SM represented as "star" as shown in FIG. 19.

When the user partially removes transfer sheet HS along star-shaped perforation PSb, a star-shaped opening is consequently defined on transfer sheet HS. Thereafter, embroidery pattern SM represented as "star" in double-dot chain line is sewn by embroidery sewing machine 2 and transfer sheet HS may then be removed from T-shirt TS.

As described above, since perforation PSb is formed within the outline of embroidery pattern SM by a predetermined distance based on perforation data, embroidery pattern SM is sewn on the workpiece cloth after removing transfer sheet HS along perforation PSb.

According to the above described arrangement, even if needle holes are formed on the workpiece cloth by perforation PSb, the needle holes formed by perforation PSb can be hidden by embroidery pattern SM sewn afterwards. Moreover, since transfer sheet HS is partially removed to the extent of the outline of embroidery pattern SM, the remaining transfer sheet HS may be removed neatly after sewing embroidery pattern SM with greater ease.

Next, a description will be given on a third modified exemplary embodiment.

Figure 20:
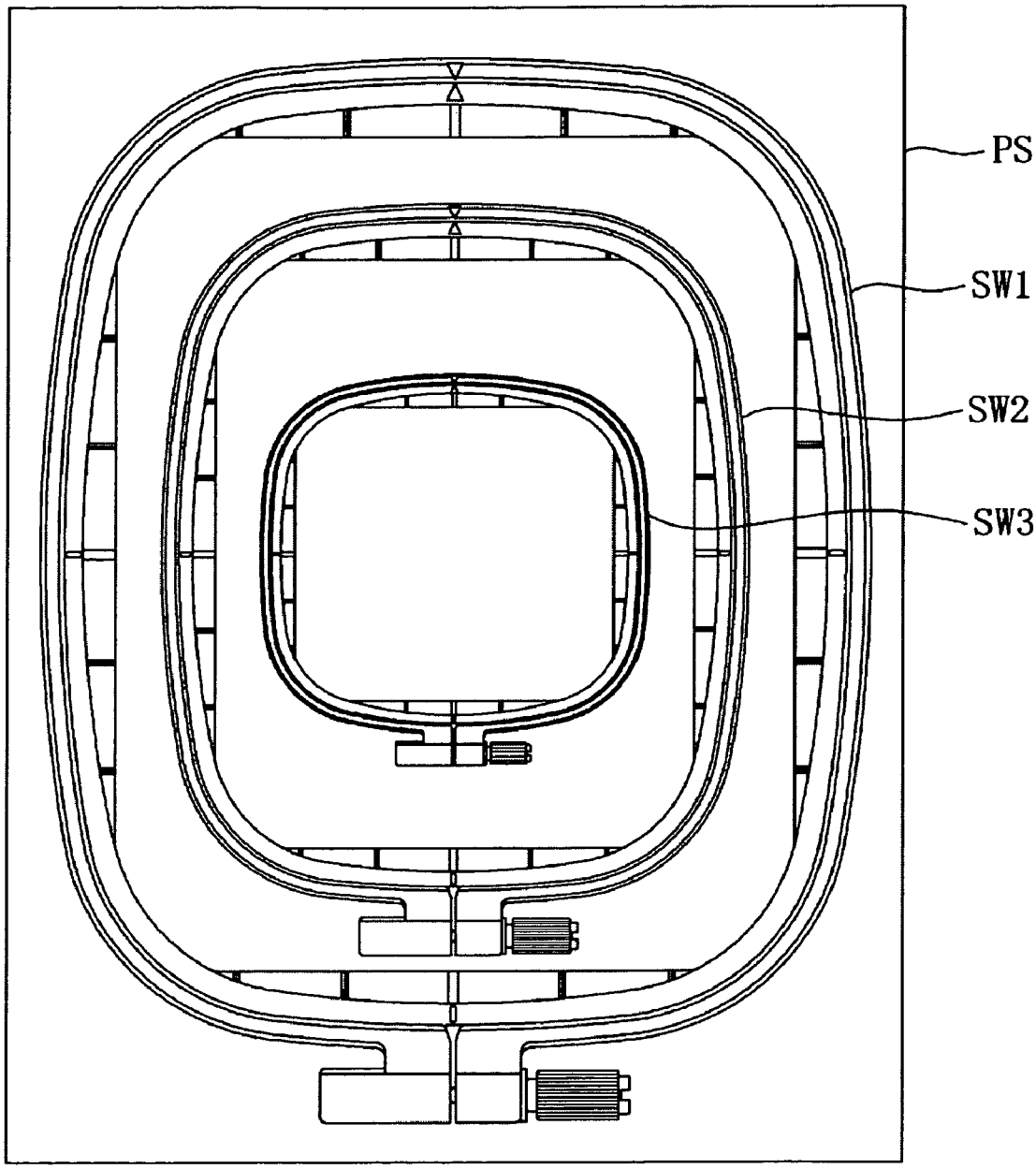
FIG. 20 is a rear view of the transfer sheet with three types of frame prints printed on its back side.

Instead of printing frame print SW on the back side of transfer sheet HS each time, ready-made transfer sheets HS having various types of frame prints represented as SW1 to SW3 in FIG. 20, for instance, may be made commercially available to the user. In such case, the user is to purchase a transfer sheet HS that conforms to the embroidery frame type of the user's embroidery sewing machine. In this case also, since frame-print printing data for frame prints SW1 to SW3 are pre-stored in hard disc 11*e*, positioning and sizing of image pattern PM and embroidery pattern SM can be edited through display 12 of data processor 1. The above approach further allows S18 of the data processing control to be eliminated. Frame prints SW being printed on the back side of transfer sheet HS is not limited to three types.

Next, a description will be given on a fourth modified exemplary embodiment.

Embroidery frame 31 is not limited to the shape described in the present embodiment, but may come in shapes such as circular, ellipse or rectangular shapes. The frame-print printing data corresponding to these frame shapes may be stored in hard disc 11*e*.

Next, a description will be given on a fifth modified exemplary embodiment.

Embroidery frame 31 is not limited to an outer and inner frame configuration described in the above described exemplary embodiment but may come in other configurations such as a clamp configuration in which the workpiece cloth is held by being vertically clamped by planar surfaces of an upper frame and a lower frame, and a cylindrical frame configuration in which the workpiece cloth is held on a cylindrical surface.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A data processor that processes embroidery data for sewing an embroidery pattern on a workpiece cloth held by an embroidery frame attached to an embroiderable sewing machine, and printing data for printing an image pattern with a printer to be transferred onto the workpiece cloth through a thermal transfer sheet, the data processor, comprising:

a printing data processor that includes reference-mark printing data for printing a reference mark with the printer on a back side of the thermal transfer sheet, the reference mark being used for positioning the workpiece cloth relative to the embroidery frame, and a print position specifier that specifies printing position of the image pattern relative to the reference mark, the image pattern being printed on a front side of the thermal transfer sheet; and an embroidery data processor that includes a sew position specifier that specifies sew position of the embroidery pattern relative to the reference mark.

2. The data processor according to claim 1, wherein the reference mark comprises a frame print that represents printed image of one or more types of embroidery frames.

3. The data processor according to claim 1, wherein the printing data processor includes a print size specifier that specifies print size of the image pattern and a sew size specifier that specifies sew size of the embroidery pattern.

4. The data processor according to claim 1, wherein the embroidery data processor includes perforation data generator that generates perforation data for forming perforations that outline a rectangular or polygonal pattern area that encloses the embroidery pattern.

5. The data processor according to claim 1, wherein the embroidery data processor includes perforation data generator that generates perforation data for forming perforations within an outline of the embroidery pattern by a predetermined distance.

6. A data processor that processes embroidery data for forming an embroidery pattern on a workpiece cloth held by an embroidery frame attached to an embroiderable sewing machine, the data processor, comprising:

a thermal transfer sheet that has a reference mark printed on its back side, the reference mark being used for positioning the workpiece cloth relative to the embroidery frame;

a printing data processor that includes a print position specifier that specifies printing position of an image pattern relative to the reference mark, the image pattern being printed by a printer on a front side of the thermal transfer sheet;

an embroidery data processor that includes a sew position specifier that specifies sew position of the embroidery pattern relative to the reference mark.

7. The data processor according to claim 6, wherein the reference mark comprises a frame print that represents printed image of one or more types of embroidery frames.

8. The data processor according to claim 6, wherein the printing data processor includes a print size specifier that specifies print size of the image pattern and a sew size specifier that specifies sew size of the embroidery pattern.

9. The data processor according to claim 6, wherein the embroidery data processor includes perforation data generator that generates perforation data for forming perforations that outline a rectangular or polygonal pattern area that encloses the embroidery pattern.

10. The data processor according to claim 6, wherein the embroidery data processor includes perforation data generator that generates perforation data for forming perforations within an outline of the embroidery pattern by a predetermined-distance.

11. A computer readable medium that stores a data processing program for processing embroidery data for sewing an embroidery pattern on a workpiece cloth held by an embroidery frame attached to an embroiderable sewing machine, and printing data for printing an image pattern with a printer to be transferred onto the workpiece cloth through a thermal transfer sheet, the data processing program stored in the computer readable medium comprising:

instructions for preparing reference-mark printing data for printing a reference mark on a back side of the thermal transfer sheet with the printer, the reference mark being used for positioning the workpiece cloth relative to the embroidery frame;

instructions for specifying positioning of the image pattern relative to the reference mark, the image pattern being printed on a front side of the thermal transfer sheet; and instructions for specifying positioning of the embroidery pattern to be sewn relative to the reference mark.

12. The medium according to claim 11, further comprising instructions for specifying a print size of the image pattern and instructions for specifying a sew size of the embroidery pattern.

13. The medium according to claim 11, further comprising instructions for forming perforation data for forming perforations that outline a rectangular or polygonal pattern area that encloses the embroidery pattern.

14. The medium according to claim 11, further comprising instructions for forming perforation data for forming perforations within an outline of the embroidery pattern by a predetermined distance.

15. A computer readable medium that stores a data processing program for processing embroidery data for sewing an embroidery pattern on a workpiece cloth held by an embroidery frame attached to an embroiderable sewing machine, the data processing program stored in the computer readable medium, comprising:

instructions for specifying positioning of an image pattern being printed on a front side of a thermal transfer sheet relative to a reference mark being printed on a back side of the thermal transfer sheet, the reference mark being used for positioning the workpiece cloth relative to the embroidery frame; and instructions for specifying positioning of the embroidery pattern to be sewn relative to the reference mark.

16. The medium according to claim 15, further comprising instructions for specifying a print size of the image pattern and instructions for specifying a sew size of the embroidery pattern.

17. The medium according to claim 15, further comprising instructions for forming perforation data for forming perforations that outline a rectangular or polygonal pattern area that encloses the embroidery pattern.

18. The medium according to claim 15, further comprising instructions for forming perforation data for forming perforations within an outline of the embroidery pattern by a predetermined distance.

* * * * *